US006190228B1

(12) United States Patent
Hoogenboom et al.

(10) Patent No.: US 6,190,228 B1
(45) Date of Patent: Feb. 20, 2001

(54) TODDLER TOY SYSTEM AND METHOD

(75) Inventors: Irene Hoogenboom; Mary Y. Todd, both of Beaufort, SC (US); Ellen Booth Church, Ithaca, NY (US)

(73) Assignee: Environments, Inc., Beaufort ( * ) Notice: Under 35 U.S.C. 154(b), the term of this patent shall be extended for 0 days.

(21) Appl. No.: 09/350,488

(22) Filed: Jul. 9, 1999

(51) Int. Cl.[7] ..... A63H 33/08

(52) U.S. Cl. ..... 446/117; 446/118; 446/119; 446/490

(58) Field of Search ..... 446/69, 85, 117, 446/118, 119, 168, 169, 173, 174, 444, 486, 489, 490; 454/300, 302, 259, 407

(56) References Cited

U.S. PATENT DOCUMENTS

| | | | | |
|---|---|---|---|---|
| 1,329,850 | * | 2/1920 | Pye | 446/117 X |
| 2,399,566 | * | 4/1946 | Owen | 446/117 X |
| 2,542,948 | * | 2/1951 | Scherf | 434/259 |
| 2,757,479 | * | 8/1956 | Brennan et al. | 446/117 |
| 3,339,291 | * | 9/1967 | Ruchlis | 434/302 |
| 3,567,221 | * | 3/1971 | Stults | 434/302 X |
| 3,765,121 | * | 10/1973 | Vennola | 446/117 |
| 4,026,065 | | 5/1977 | Walter . | |
| 4,249,336 | | 2/1981 | Moe et al. . | |
| 4,319,425 | * | 3/1982 | Shine | 446/168 |
| 4,534,736 | | 8/1985 | Cogdill . | |
| 4,609,356 | * | 9/1986 | Gilden et al. | 434/259 |
| 4,778,392 | | 10/1988 | Mitchell . | |
| 4,952,153 | * | 8/1990 | McAllister | 434/259 |
| 5,035,666 | | 7/1991 | Kang . | |
| 5,046,984 | * | 9/1991 | Cane | 446/168 |
| 5,139,453 | * | 8/1992 | Aikern et al. | 434/259 X |
| 5,916,006 | * | 6/1999 | Ganson | 446/85 |
| 5,999,317 | * | 12/1999 | Whitney | 359/501 |

* cited by examiner

*Primary Examiner*—D. Neal Muir
(74) *Attorney, Agent, or Firm*—Sofer & Haroun, LLP

(57) ABSTRACT

An educational and recreational toy system for toddlers including a plurality of toy components having various shapes and sizes. The various shapes and sizes of the components are based upon a unit measurement. Toy structures are provided, including a balance, a stringer, and a pegboard for integrated use with the components. The toy components may be used interchangeably among the various toy structures. According to the invention, the system allows a child to improve motor, coordination, and thinking skills. This is accomplished by using the toy components—in conjunction with the toy structures—for matching, piling, patterning, and balancing exercises.

12 Claims, 8 Drawing Sheets

30

TODDLER TOY SYSTEM AND METHOD

FIELD OF THE INVENTION

This invention relates to a toy system for use by toddlers, the system having interchangeable component parts, and a method of use thereof.

BACKGROUND OF THE INVENTION

While toys are typically considered to be play items for children, toys also serve a more important role. Namely, toys help to develop proficiency in motor, coordination, and thinking skills. With this in mind, some toys are designed expressly to aid in developing the minds and skills of children. Regardless, even toys that are designed specifically to entertain, routinely help improve the aforementioned skills.

In designing toys, a prime consideration is the age group for which a particular toy is directed. Toys intended for use by children under the age of one often provide sensory stimulation—triggered by the child—in the form of sound and light. One such toy, commonly known as a rattle, creates noise when moved by a child. As they grow older, children are introduced to toys for which simple rules govern play. These toys often develop skills through repetitive tasks. Eventually, a child may graduate to relatively complex board games and the like, in which detailed rules govern play. Such toys are typically designed for multiple users and have the further goal of building social skills.

Toys that are specifically intended for use by toddlers (children under the age of three) are designed to allow children to carry out elementary functions such as inserting, matching, piling, patterning, balancing, and the like. In turn, these toys typically consist of a collection of common objects such as blocks, rings, and pegs. Using such objects, a child is provided with tasks bounded by simple rules. For example, a goal may be to group objects having the same color, or to stack objects having the same shape.

The prior art is replete with examples of toys specifically intended for use by toddlers. A well known toy includes a rope along with rings and beads. The child threads the rings and/or beads on the rope in various patterns. Another toy that is well known in the prior art is a pegboard. Such a toy consists of a board, on which pegs are disposed, along with rings that are to be arranged on the pegs. As with the rope toy, the rings can be arranged in a pattern. Simple balances having a lever and fulcrum have also been used as toys. The lever of such a balance may include buckets in which weighted objects are to be placed, or in the alternative, pegs may be disposed on the balance to receive rings or other objects.

While the aforementioned educational toys are simple, it is unquestionable that they have vast importance in helping to develop the minds of toddlers. However, play with these individual toys becomes monotonous with time. While a group of these toys can be provided to a child, acquiring the toys separately is not economical. Instead, because such toys typically make use of similar components, a system of toy structures using a single set of components would provide better value to the purchaser of such a system.

With regard to the standard toddler toys discussed, novel variations have been disclosed in the prior art. However, none of these toys includes the ability to use toy components interchangeably with more than one of the standard toys. For instance, U.S. Pat. No. 5,035,666 to Kang discloses a recreational toy including blocks having rectangular protrusions. The blocks have letters and symbols on their faces. A platform is also provided on which the blocks may be securely placed. However, the blocks and platform are designed to be used in one way and lack the flexibility to be used in conjunction with other types of toys.

The inflexibility of prior art toys for toddlers is also demonstrated by U.S. Pat. No. 4,534,736 to Cogdill. This patent discloses an educational toy comprising a threaded shaft upon which blocks are rigidly fixed to opposite ends. Between the fixed blocks are blocks that are rotatable and otherwise moveable. In turn, the blocks can be aligned in various desired patterns. However, because the blocks are fixed to the shaft, the blocks can be used for one intended purpose.

Thus, there remains a need for a toy system that is provided with one or more toy structures, such as a balance, a stringer, and a pegboard. The system would include toy components such as blocks, rings, and the like, that can be interchangeably used with each toy structure.

SUMMARY OF THE INVENTION

An object of the present invention is to provide a toy system that functions as an amusement device and as a skill building tool.

Another object of this invention is to provide a group of toy components that can be used interchangeably with a group of toy structures.

It is yet another object of the present invention to provide a group of toy components that are sized according to a unit measurement.

In accordance with one embodiment of the invention, toy components are provided consisting of rings, cylinder rings, columns, and plaques. Each toy component has a hole communicating between two of the component's surfaces allowing the components to be utilized with a variety of toy structures. These structures include, balances, pegboards, and stringers, all of which are designed to accommodate the toy components. As the sizes of components are based on a unit measurement, stacking exercises, and the like, are enhanced.

The above description sets forth rather broadly the more important features of the present invention in order that the detailed description thereof that follows may be understood, and in order that the present contributions to the art may be better appreciated. Other objects and features of the present invention will become apparent from the following detailed description considered in conjunction with the accompanying drawings. It is to be understood, however, that the drawings are designed solely for the purposes of illustration and not as a definition of the limits of the invention, for which reference should be made to the appended claims.

DETAILED DESCRIPTION OF THE INVENTION

Figure 1:
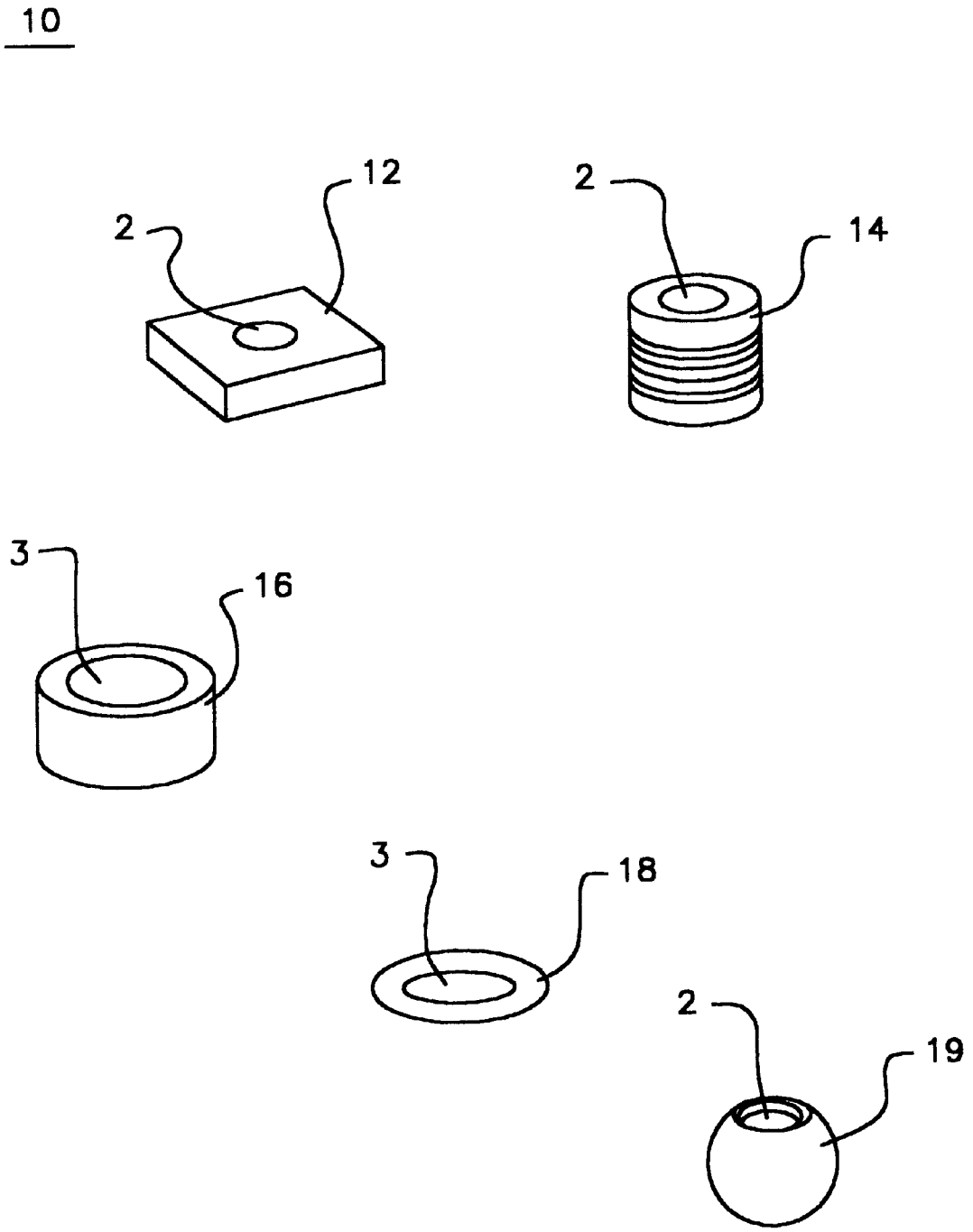
FIG. 1 is a perspective view of various toy components that are used in conjunction with a stringer, a balance, and a pegboard.

With reference to FIG. 1, toy components 10, that are used interchangeably with multiple toy structures, are shown. Square plaque component 12 is a rectilinear block having four sides of equal length. At the center of square plaque component 12 a hole 2 is provided. Cylinder component 14, is a cylindrically shaped block having a hole 2 provided through its center. In one embodiment, ridges may be disposed on the outside surface of cylinder component 14. Bead component 19 is a sphere having a hole 2 provided through its center. Column ring 16, is a cylindrically shaped block having an open center 3. Open center 3 has a diameter that is large enough to allow column ring 16 to pass over cylinder component 14 and bead component 19. Ring component 18 is a ring having a circular cross-section. Like column ring 16, the open center 3 of ring 18 allows it to pass over cylinder 14 and bead 19. Components 10 shown in FIG. 1 represent a small example of the many different shapes and sizes that can be used in conjunction with this system.

In the preferred embodiment, all of the aforementioned components 10 are fabricated from wood. A number of each of the components 10 are provided. In one embodiment, each component 10 has a different color and height. Preferably the heights are multiples of one another. For instance, cylinder component 4 and column ring component 16 are provided with heights of 1½ inches, and 3 inches. Likewise, square plaque component 12 has a height of ½ inch and may be provided at heights of 1 inch, ½ inches, and other heights.

The mathematical equivalency between components 10 creates an important feature of the system. Namely, stacking an appropriate number of shorter components 10 will result in a height that is equivalent to a taller component. For instance, two column rings 16 that are 1½ inches in height can be stacked on top of one another and together approximate the height of a 3 inch column ring 16. Thus, throughout the system, stacking exercises are enhanced, allowing a child to discover and understand the dimensional relationship between components 10.

The texture that may be applied to cylinder component 14 is ornamental in nature and also serves three or more utility functions. (It should be noted that such texture may also be applied to any of the other components 10.) It is important that a child learns to recognize varying surface textures. The texture applied to components 10 is visually stimulating to a child user. Likewise, the surface texture appeals to the sense of touch. The texture allows a child to understand the words associated with different surfaces. Additionally, as mentioned above, column ring 16 and ring 18 may be capable of passing over cylinder 14. If cylinder 14 is ribbed or otherwise textured, column ring 16 and cylinder 14 may vibrate as column ring 16 is passed over cylinder 14. Such a vibration may be of a frequency that it is audible to the human ear. In turn, a textured component 10 can provide auditory stimulation.

Stringer Toy Structure

Figure 2A:
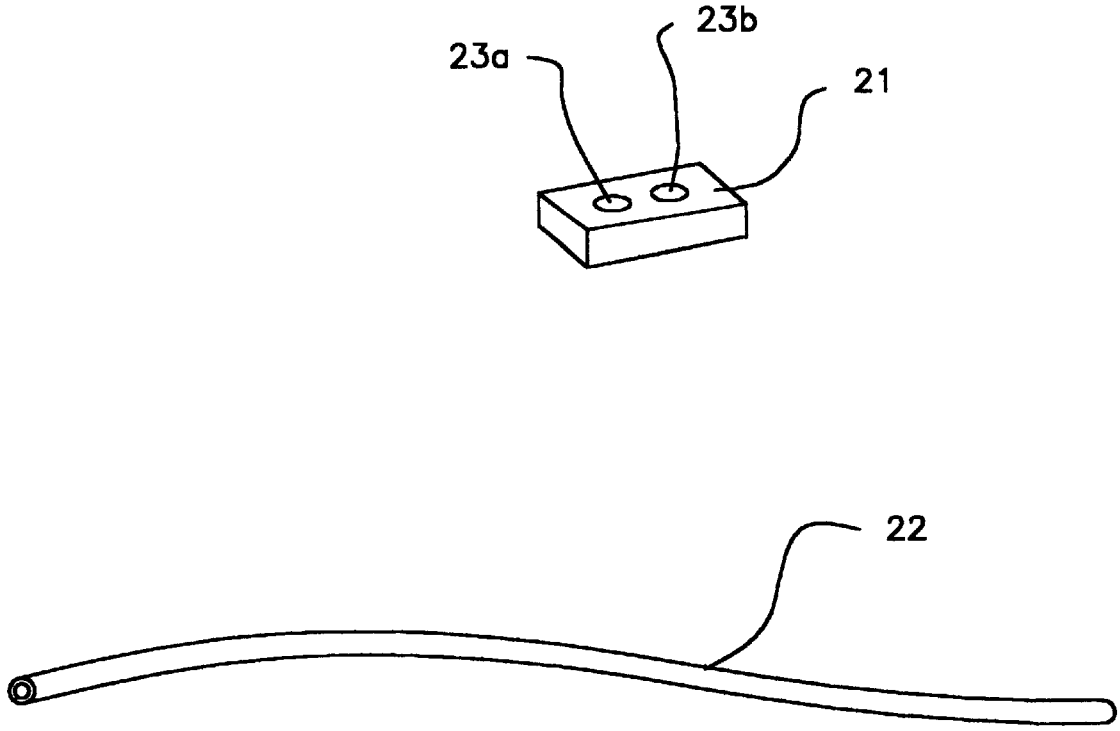
FIG. 2*a* is a perspective view of a stopper and stringer toy structure.

Turning now to FIG. 2*a,* a stopper 21 and a stringer 22 are shown. Stopper 21 is preferably fabricated from wood in the shape of a six-sided rectangular form. However, stopper 21 may take on virtually any shape as long as the stopper 21 is provided with two or more stringer holes 23*a* and 23*b* communicating between two of its faces. Stringer 22 is preferably fabricated from flexible, hollow tubular material with a cylindrical rope-like shape having a length that is greater than its diameter. Preferably the length of stringer 22 is at least ten times greater than the diameter of stringer 22. As shown in FIG. 2*a,* the diameter of stringer 22 is smaller than the diameter of stringer holes 23 to allow insertion of stringer 22 into holes 23*a* and 23*b*.

In one embodiment, to begin use of stringer 22 with components 10, stopper 21 is first applied to stringer 22. First, one end of stringer 22 is inserted through hole 23*a* in stopper 21. Stringer 22 is then bent to allow the same end of stringer 22 to enter hole 23*b* from the opposite direction. Stringer 22 is flexible and biased towards its linear configuration. Thus, when an end of stringer 22 is placed in holes 23 as described, stringer 22, in a bid to move to its unbiased position, is forced against the sides of holes 23. The friction produced between stringer 22 and stopper 21 serves to hold stringer 22 in place.

Figure 2B:
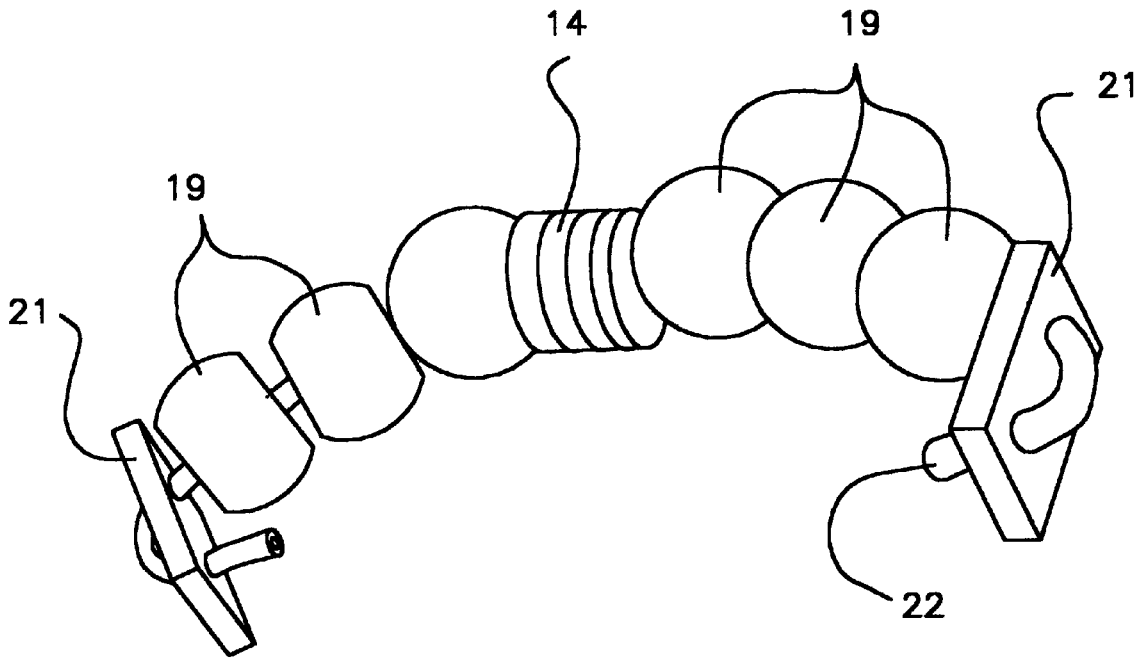
FIG. 2*b* is a perspective view of a stringer with various components and stoppers.

Now with reference to FIG. 2*b,* after stopper 21 is attached to stringer 22, components 10 may be threaded onto stringer 22. Threading components 10 on stringer 22 may help to improve the hand-eye coordination of a child. Additionally, a child may learn to group colors and shapes when stringing components 10. Also, as described above, textured components 10, that have outer diameters that are smaller than the inner diameters of other components 10, can produce sound when moved appropriately. When a desired amount of components 10 are threaded onto stringer 22, another stopper 21 may be attached to the other end of stringer 22 in the manner described.

Balance Toy Structure

Figure 3A:
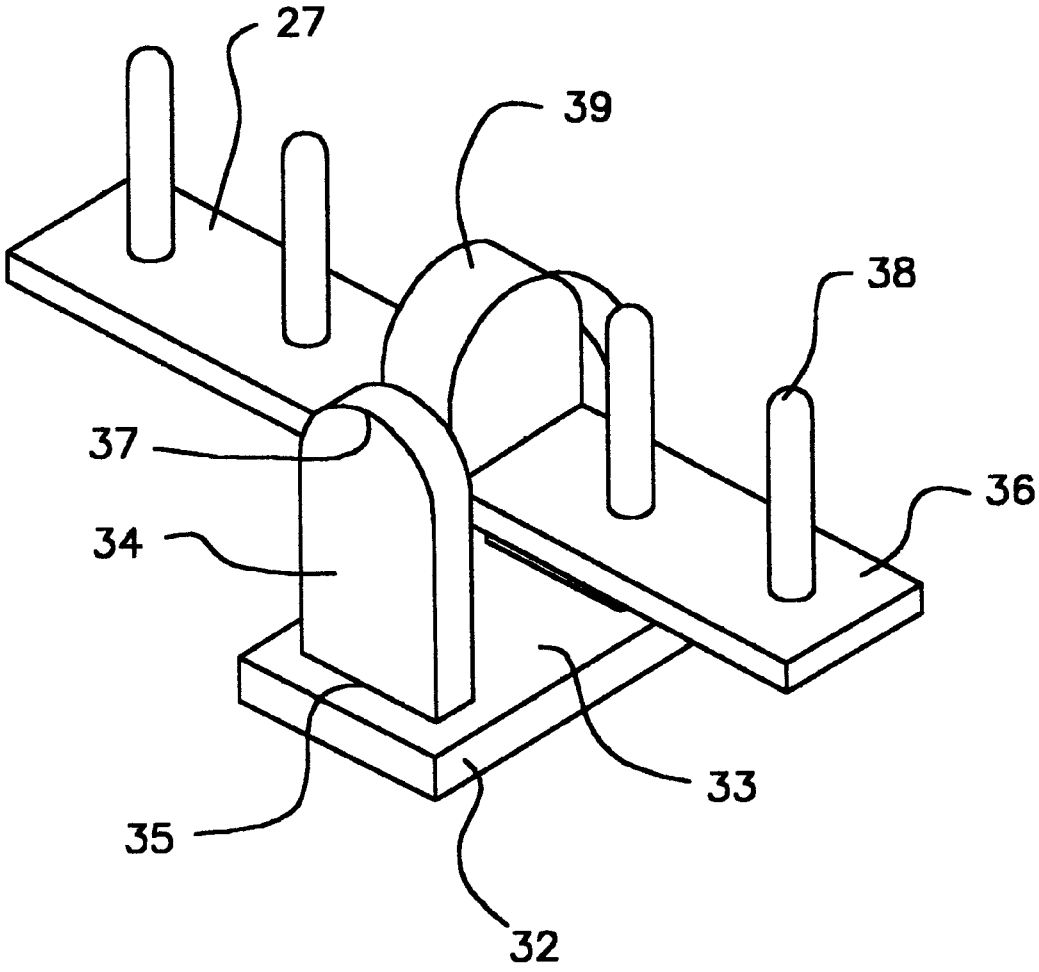
FIG. 3*a* is a perspective view of a balance toy structure.

Pictured in FIG. 3*a* is a balance toy structure 30. Balance toy structure 30 is constructed from two main components that are separable from one another. The first component comprises a base 32 and side supports 34. The second component comprises balance board 36 along with center mass 39 and pegs 38.

Base 32 preferably has a generally rectilinear shape which, in one embodiment, has a length of six inches, a width of four inches, and a thickness of approximately three-fourths of an inch. However, many shapes and sizes may be used as an appropriate base 32 as long as a stable flat surface is provided. Side supports 34 are similar in shape to base 32 but, in one embodiment, have rounded tops 37. Side supports 34 can be attached to base 32 in a number of ways. For instance, a mortise and tenon joint may be provided. In such a case, appropriate glue can be used to seal the joint. In another instance, threaded fasteners may be employed to attach side supports 34 to base 32.

Figure 3B:
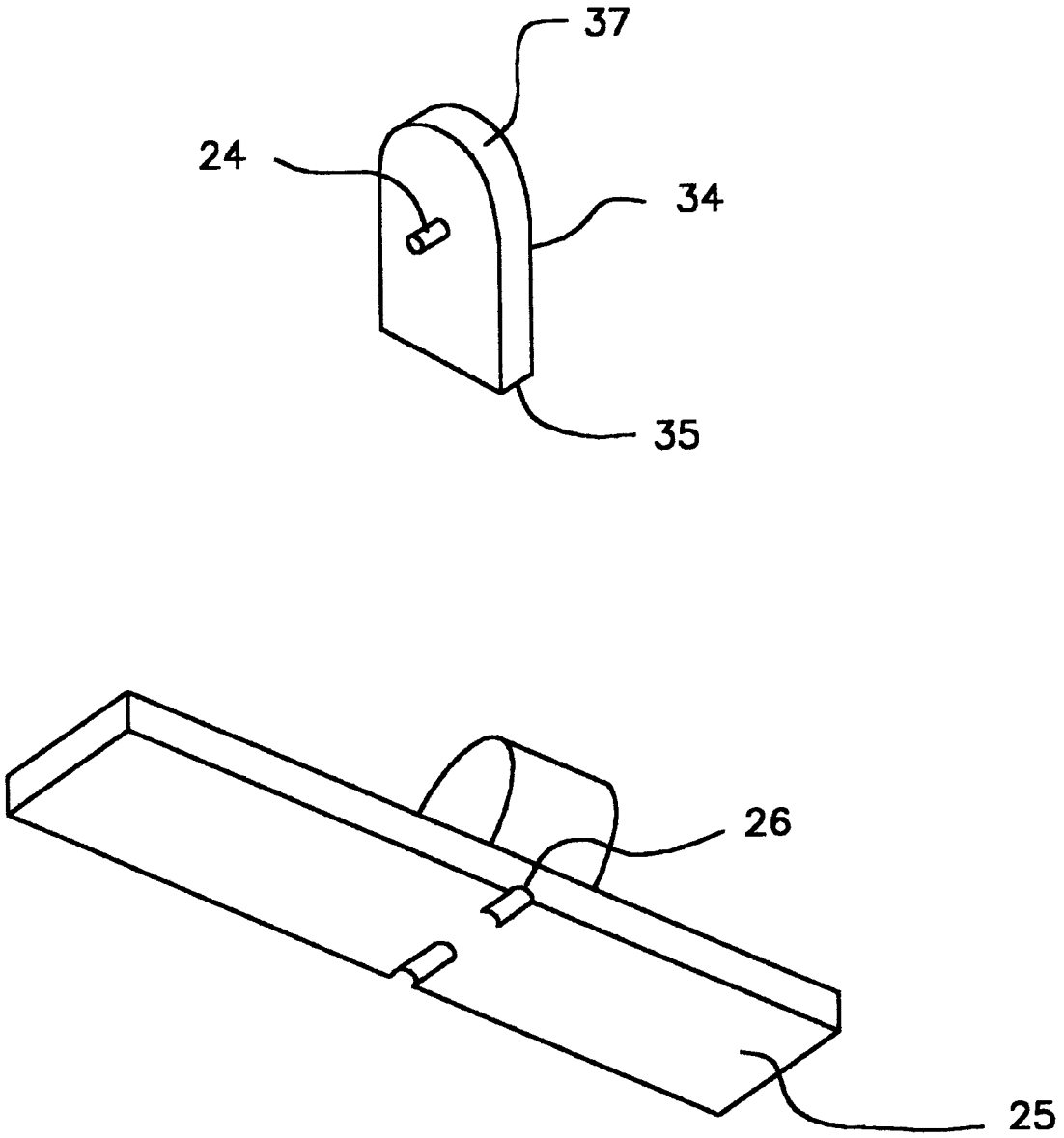
FIG. 3*b* is an exploded perspective view of the balance toy structure as shown in FIG. 3*a;*

Turning now to FIG. 3*b,* a view of a side support 34 is presented exposing details that cannot be seen in FIG. 3*a*. Disposed on one side of side support 34 is a pin 24. Pin 24 corresponds to a channel 26 which is discussed below in more detail. In the preferred embodiment, pin 24 is disposed within a hole provided in one side of side support 34. The pin may be held in place by a friction, glue, or other appropriate means.

Balance board 36 has a generally rectilinear shape. In one embodiment, balance board 36 is sixteen inches in length, two and three-quarters inches in width, and one-half inch thick. Turning once again to FIG. 3*b* a view of balance board 36 is presented which exposes details that cannot be seen in FIG. 3*a,* namely, bottom surface 25 of balance board 36. At the center of balance board 36, channels 26 are configured to extend longitudinally from the edges of balance board 36 in a fashion perpendicular to the edges. Channels 26 may also be one channel extending across the entire width of balance board 36. Alternatively, channels 26 may be replaced by holes (not shown) in the side of balance board 36. During construction of balance toy structure, pins 24 would be inserted into the holes large enough to allow balance board 25 to freely rotate.

Turning back now to FIG. 3*a,* top surface 27 of balance board is shown. Disposed on top surface 27 are pegs 38 and center mass 39. Pegs 38 and center mass 39 may be attached to balance board 36 utilizing appropriately shaped cavities on balance board, threaded fasteners, or other means. In one embodiment, pegs 38 are themselves threaded and the appropriately shaped cavities are tapped to receive pegs 38. Preferably, pegs 38 are each disposed a unit distance from the center of balance board 36. For example, if a peg 38 is disposed two inches from the center of balance board 36, another peg 38 would be disposed four inches from the center of balance board 36. In the preferred embodiment, the balance 30 is fabricated from wood.

In addition to being used with stinger 22, components 10 are also used in conjunction with balance 30. Pegs 38 disposed on balance 30 are designed to receive components 10. Components 10 are placed on pegs 38 in varying configurations. By doing so, a child user may learn about balancing properties. Components 10 placed on balance 30 create a moment about the center of balance board 36. This moment can be described by the formula:

$$M=r\times F$$

where M is equivalent to the moment, r is equivalent to the distance of the component from the center of the balance board, and F is equivalent to the force exerted by component 10 on balance board 36. Balance board 36 will remain level when the moment on one side is equivalent to the moment on the other side. This can also be represented with a formula which is as follows:

$$r_1\times F_1=r_2\times F_2$$

where the subscript "1" refers to the first side of balance board 36 and subscript "2" refers to the second side of balance board 36.

Because components 10 such as cylinder 4 are provided in varying sizes, they are necessarily provided in varying weights as well. As sizes are multiples of one another, weights are roughly multiples as well. Thus, for example, a child can discover that two cylinders 14 will balance one cylinder 14 that is double the height of the other two (this assumes that the cylinders are placed on pegs 38 that are equidistant from center mass 39). In another example, a child may discover that a first component 10 positioned one unit from the center will balance a second component 10 that is half the weight of the first component 10 and positioned two units from the center.

Pegboard Toy Structure

Figure 4:
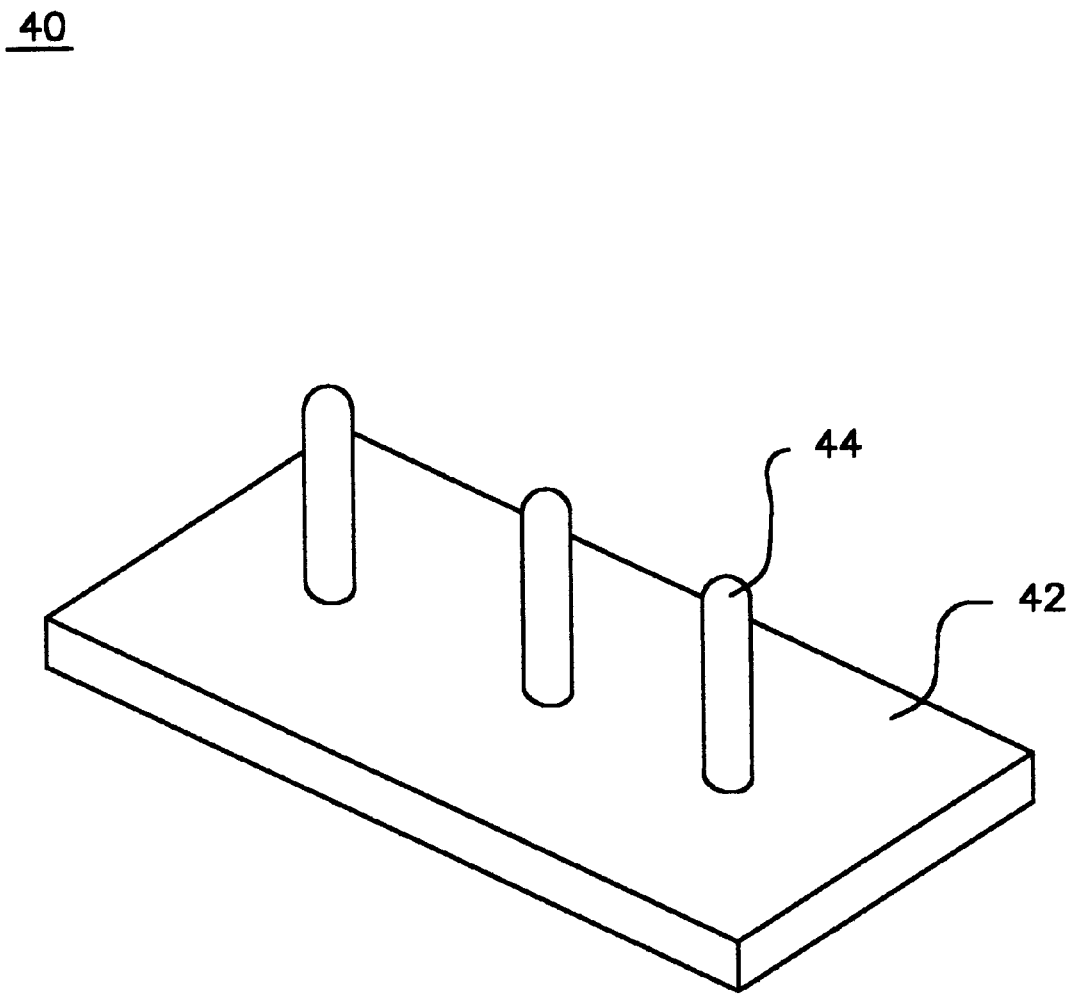
FIG. 4 is a perspective view of a peg board toy structure.

FIG. 4 provides a view of a pegboard toy structure 40 that is comprised of base 42 and pegs 44. While any number of pegs 44 may used, in the preferred embodiment three pegs 44 are selected. Pegs 44 can be attached to base 42 in a number of ways. Cavities may be provided on base 42 corresponding to the diameter of pegs 44. Pegs 44 may then be friction fitted or glued into the holes. Alternatively, threaded fasteners may be used to attach pegs 44 to base 42. As with balance 30, pegs 42 may be threaded and thus screwed into corresponding tapped cavities. Pegs 42 preferably have a diameter that is smaller than the inside diameter of components 10. In one embodiment, all pegs 44 on board 42 have the same diameter. More than one pegboard toy structure 40 may be provided, each having pegs 44 with a different diameter. In the preferred embodiment pegboard toy structure 40 is fabricated from wood.

With continued reference to FIG. 4, it can be seen that components 10 may also be used in conjunction with pegboard toy structure 40. As with stringer 22, components 10 can be stacked and organized on pegs 44. Using pegs 44, children can observe height differences of components 10 and match colors and types of components 10. In one embodiment of the invention, more than one pegboard toy structure 40 is provided. Each pegboard toy structure 40 has pegs 44 that have different diameters. A younger child whose hand-eye coordination is not fully developed may use a pegboard 40 with relatively large pegs 44. Larger pegs 44 allow a child to more easily place components 10 on pegs 44. The child may then graduate to a pegboard 40 with relatively smaller pegs 44 as child's hand-eye coordination is better developed.

Tube Set

Figure 5:
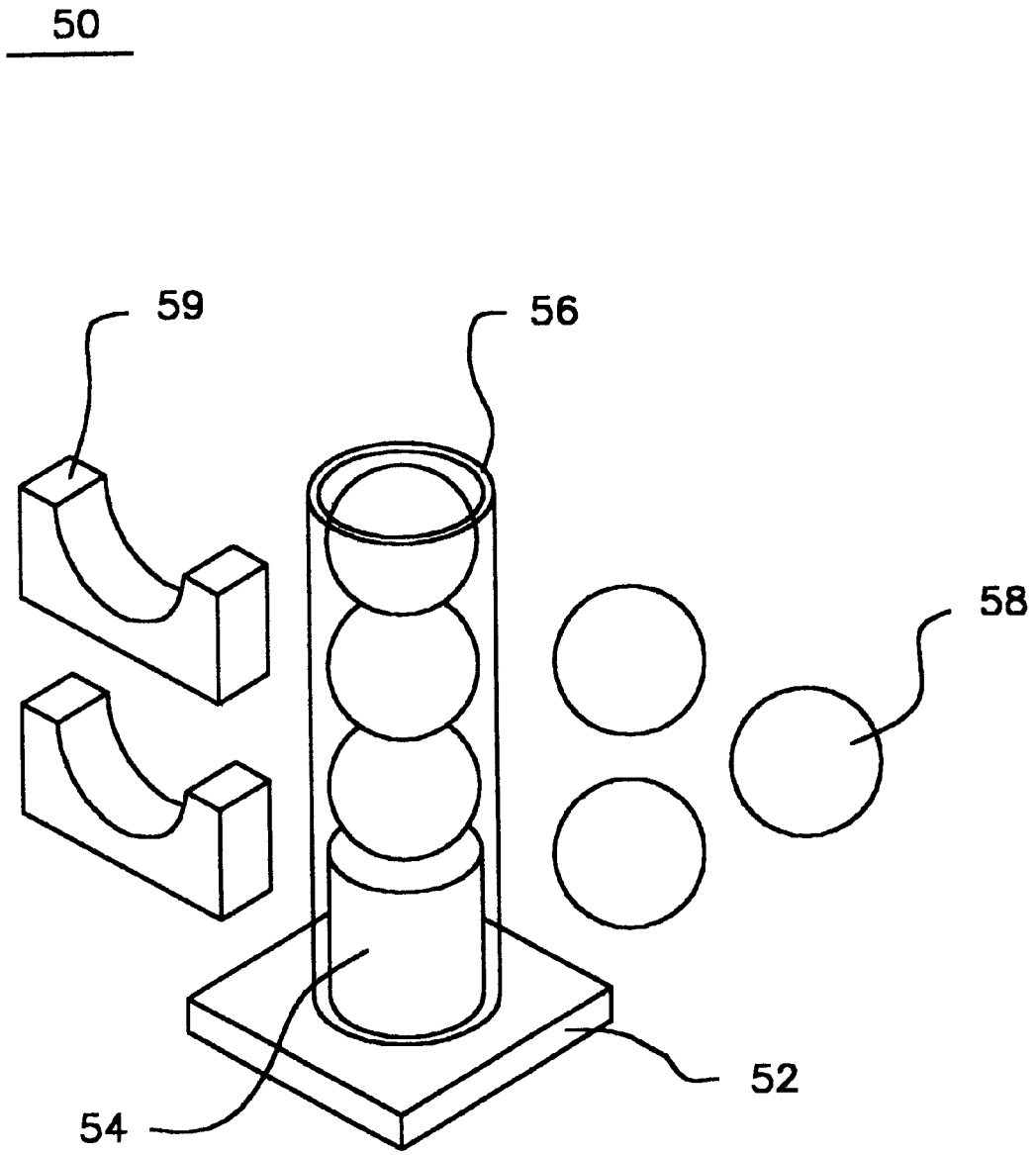
FIG. 5 is a perspective view of a tube set, the tube set having balls, a tube, and a base.

With reference to FIG. 5, a tube set 50 is shown that comprises base 52, tube holder 54, tube 56, balls 58, and stands 59. Tube holder 54 has a generally cylindrical shape. In one embodiment, tube holder 54 is attached to base 52 utilizing a hole provided in base 52. In one embodiment, tube holder 54 is glued into the hole. However, threaded fasteners or other means can also be used to attach holder 54 to base 52. Alternatively, base 52 and tube holder 54 may be one integrated piece of material. Preferably, tube holder 54 and base 52 are fabricated from wood.

Tube 56 is a length of transparent, hollow cylindrical material preferably fabricated from butyrate. Tube 56 has an inside diameter which slightly exceeds that of tube holder 54 so that tube 56 may be placed over tube holder 54. Balls 58 are spherical and have a diameter that approximates that of tube holder 54. Thus, balls 58 fit within the inside diameter of tube 56 with only a small gap between the surface of balls 58 and the inside surface of tube 56. Preferably this gap does not exceed one millimeter along the circumference of balls 58. In one embodiment, balls 58 have diameters that are equivalent to one-third the length of tube 56 when subtracting the length of tube holder 54. Therefore, when tube 56 is placed on tube holder 54 and balls 58 are inserted into tube 56, the surface of a ball 58 is level with the opening of the tube. Stands 59 may also be provided and are preferably fabricated from wood. Stands 59 are rectilinear in shape with a semicircular piece of material cut away from the block. Preferably the radius of the semicircle is half that of the outer diameter of tube 56.

Balls 58 may be placed inside tube 56 to demonstrate the way in which balls 58 stack upon one another. Tube 56 may be placed on one stand 59 such that tube 56 is at an angle to a flat horizontal surface. Balls 58 may then be rolled through tube 56. This exercise demonstrates various laws of nature to a child. Moreover, in following balls 58 as they move, the child is likely to experience visual tracking. Visual tracking is an important skill that allows a child to become better aware of the surrounding dynamic environment.

Because the inside diameter of tube 56 is only slightly larger than balls 58, when the airflow is restricted out of one end of tube 56 (for example, by placing tube 56 on tube holder on base 54), and a ball 58 is inserted in the other end of the tube, air trapped in the tube must pass out past the ball. A vibration is caused by the air as it passes through the small space between ball 58 and tube 56. This vibration may be audible (making a "whooshing sound") and may thus provide additional sensory stimulation for the child. Also, when airflow is restricted, balls 58 tend to glide relatively slowly within the tube. On the other hand, when airflow is unrestricted, balls 58 tend to roll unimpeded through the tube at a relatively faster rate. These differences may be observed by the child-user and provide further learning opportunities.

Shape Board and Fitting Board Toy Structures

Figure 6:
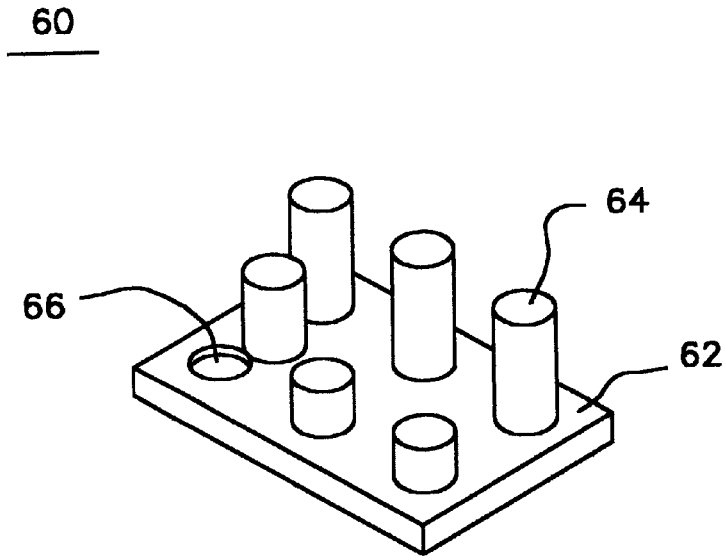
FIG. 6 is a perspective view of a fitting board, the fitting board having a board and board pieces.
Figure 7:
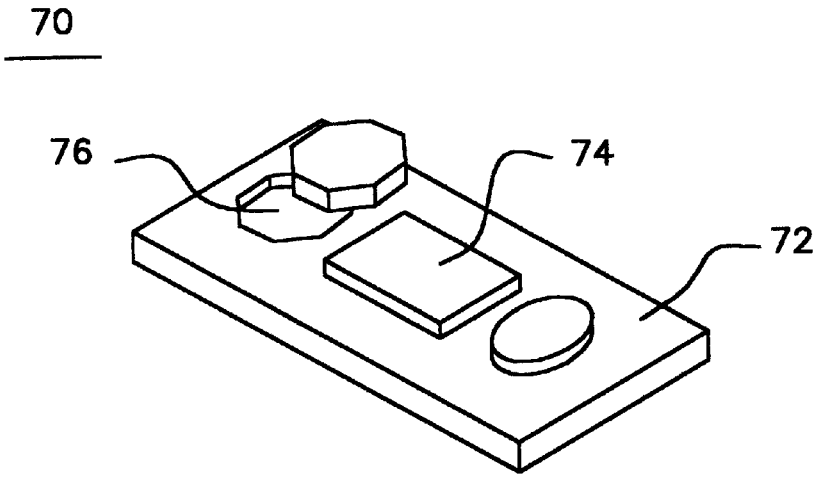
FIG. 7 is a perspective view of a shape board, the shape board having a board and shape blocks.

Shape board toy structure 60 and fitting board toy structure 70, which are preferably fabricated from wood, are shown in FIGS. 6 and 7. Boards 60 and 70 are generally rectilinear in shape but can be any appropriate shape as long as a flat surface is provided. Respectively, boards 60 and 70 have cavities 66 and 76 disposed upon their surfaces which correspond to the cross sections of pegs 64 and shapes 74.

With respect to pegboard 60, pegs 64 can be removed from board 62 leaving a child to replace pegs 64. Because pegs 64 may be provided at various heights, organization with respect to height may be a goal for the child. For instance, as is shown in FIG. 6, the aim may be to place shorter pegs 64 in front holes 66 and taller pegs 64 in rear holes 66. Additionally, a child may graduate from pegs 64 with a round cross-section to pegs 64 with a faceted cross section (and holes 66 with corresponding cross section). Greater skill and dexterity are required to place pegs with faceted cross sections in holes 66. In one embodiment, pegs 64 are provided in various colors. The colors allow for additional matching and sorting exercises.

With respect to shapeboard 70, shapes 74 are provided having various cross sections that correspond to the cross sections of cavities 76. Thus, a particular shape 74 fits only in its corresponding cavity 76. A child must recognize and appreciate the differences in shapes 74 when attempting to fit them into cavities 76. Advanced shape boards 72 may be provided that contain shapes 74 with relatively more facets. Also, shapes 74 may be different colors allowing for further development and stimulation for the child.

Thus, while there have been shown and described and pointed out fundamental novel features of the invention as applied to alternative embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto. It is to be understood that the drawings are not necessarily drawn to scale, but that they are merely conceptual in nature.

What is claimed is:

1. A toy system comprising:

a ring component;

a cylindrical component having an inner cylinder diameter, an outer cylinder diameter, and a cylinder height;

a column ring having an inner column diameter that is larger than said outer cylinder diameter, an outer column diameter, and a column height;

a square plaque having a plaque height;

a stringer having two ends and a stringer length and a stringer diameter, wherein said stringer length is larger than said stringer diameter; and a stopper having a top side and a bottom side, at least two holes, each of said holes communicating between said top side and said bottom side, said holes having a hole diameter larger than said stringer diameter so as to allow one of said ends of said stringer to be passed from said top side to said bottom side through one of said holes, and subsequently, to allow the same end of said stringer to be passed from said bottom side to said top side through another of said holes such that said stringer is securely held by said stopper and such that said ring, said cylinder, said column ring, and said plaque can be removably strung on said stringer.

2. A toy as defined in claim 1 wherein said stringer is fabricated from a flexible material.

3. A toy as defined in claim 2 wherein said flexible material is vinyl.

4. A toy as defined in claim 1 wherein said ring, said cylinder, said column ring, and said plaque are fabricated from wood.

5. A toy as defined in claim 1 wherein the height of said cylinder, said column ring, and said plaque is equivalent to a multiple of a unit.

6. A toy comprising:

a plurality of rings;

a plurality of cylinders, each having an inner cylinder diameter, an outer cylinder diameter, and a cylinder height;

a plurality of column rings, each having an inner column diameter that is larger than said outer cylinder diameter, an outer column diameter, and a column height;

a plurality of square plaques having a plaque height;

a base having a front portion and a rear portion;

a front side wall perpendicularly attached to said front portion of said base;

a rear side wall perpendicularly attached to said rear portion of said base;

a balance board having a first side, a second side, a middle, and a top surface, said middle of said balance board pivotally attached to said front side wall and said rear side wall;

a center mass attached to said middle of said top surface of said balance board; and a plurality of pegs perpendicularly disposed on said top surface of said balance board, each of said pegs disposed at a distance from said middle of said balance board equivalent to a multiple of a distance unit, said pegs capable of receiving said rings, cylinders, column rings, and plaques.

7. A toy as defined in claim 6 wherein said rings, said cylinders, said column rings, and said plaques are fabricated from wood.

8. A toy as defined in claim 6 wherein said distance unit is equivalent to two inches.

9. A toy as defined in claim 6 wherein the height of said cylinders, said column rings, and said plaques is equivalent to a multiple of a unit.

10. A toy comprising:

a base;

a tube holder having a tube holder diameter, attached to said base;

a tube having an inside tube diameter larger than said tube holder diameter so as to allow said tube to matingly engage said tube holder;

a plurality of balls having a ball diameter smaller than said tube diameter so as to allow said balls to occupy said tube so that when one of said plurality of balls is placed in said tube, a circumferential space between said ball and tube allows for a passage of air therethrough, said space dimensioned so that said passage of air produces an audible sound; and a plurality of support arches capable of supporting said tube horizontally on a support surface so that said tube is displaced from said support surface.

11. A toy defined in claim 10 wherein said tube is fabricated from butyrate.

12. A toy defined in claim 10 wherein said base and said tube holder, and said support arches are fabricated from wood.

* * * * *